United States Patent [19]

Kretchman et al.

[11] 4,268,098

[45] May 19, 1981

[54] RETAINING CLIP FOR REMOVABLE CABINET FOR FRONT-SERVICEABLE APPLIANCES

[75] Inventors: Gerald L. Kretchman; Robert M. Weir, both of St. Joseph, Mich.

[73] Assignee: Whirlpool Corporation, Benton Harbor, Mich.

[21] Appl. No.: 72,443

[22] Filed: Sep. 4, 1979

[51] Int. Cl.[3] ..... A47B 81/00; A47B 97/00

[52] U.S. Cl. ..... 312/210; 312/253; 312/283; 312/293

[58] Field of Search ..... 68/3 R; 312/253, 257 R, 312/100, 111, 210, 214, 253, 283, 263, 284, 311, 293; 134/200; 24/73 SS, 81 SC

[56] References Cited

U.S. PATENT DOCUMENTS

| | | | |
|---|---|---|---|
| 2,192,862 | 3/1940 | Eagley | 312/284 |
| 2,775,500 | 12/1956 | Etherington | 312/210 X |
| 3,552,579 | 1/1971 | Simon et al. | 211/126 |
| 3,922,048 | 11/1975 | Christianson et al. | 312/284 |
| 4,072,374 | 2/1978 | True, Jr. | 312/214 |

*Primary Examiner*—Casmir A. Nunberg

*Attorney, Agent, or Firm*—Hill, Van Santen, Steadman, Chiara & Simpson

[57] ABSTRACT

In a front-serviceable appliance having a base frame supporting internal components, the base frame having a front member and side members and a rear panel attached thereto, a removable cabinet has a front bottom flange overlapping and extending beneath the front base frame member, and receptacles for receiving upwardly extending tabs from the side members to position the cabinet with respect to the base. The cabinet is held in position on the base by a pair of spring clips engaging the rear panel and each having a portion abutting a top of the cabinet and curved portions extending into the cabinet through aligned slots in the top thereof to maintain a spring tension. The cabinet is thus retained without the use of screws and its removal does not impair the functional operation of the internal components.

8 Claims, 12 Drawing Figures

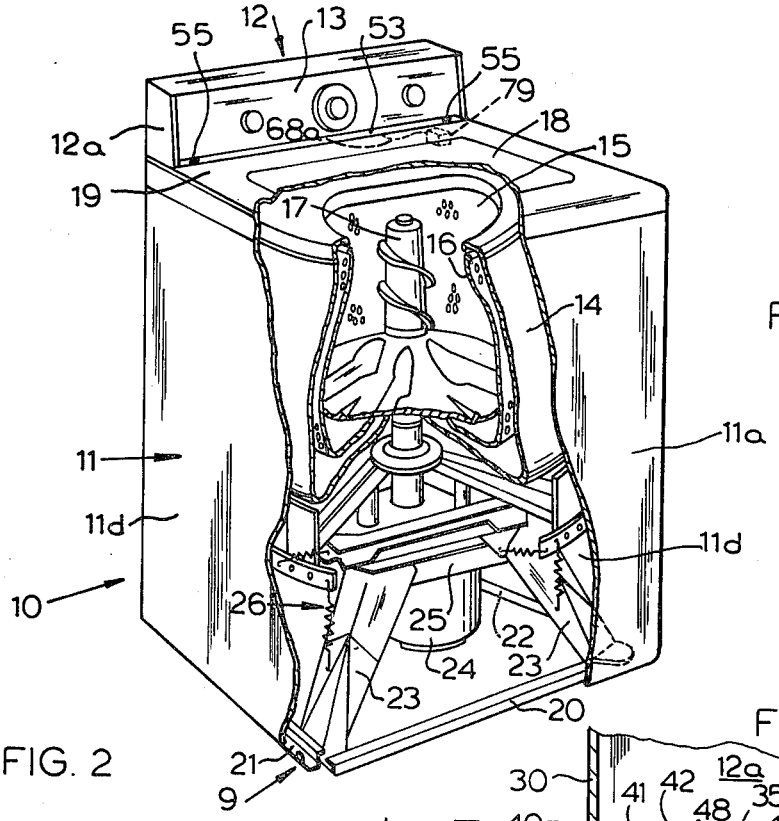
FIG. 1
FIG. 2
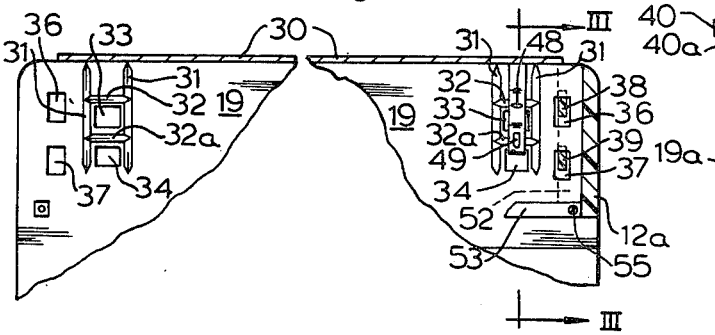
FIG. 3
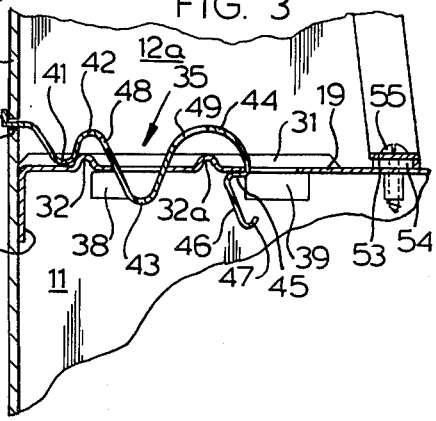
FIG. 4
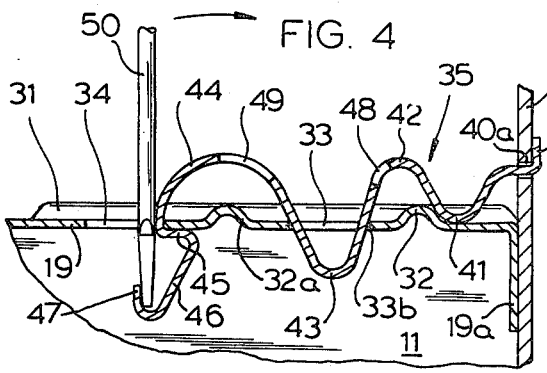
FIG. 5
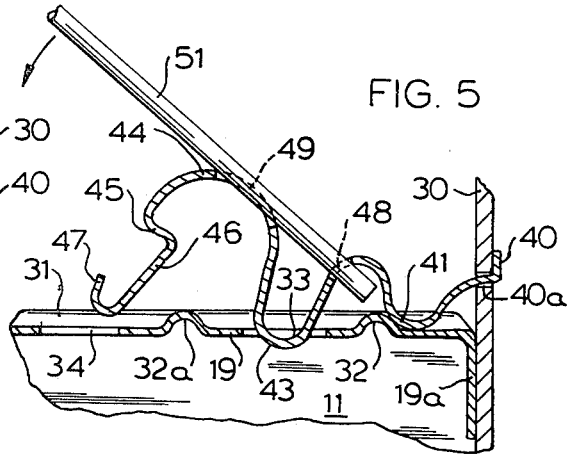

FIG. 7
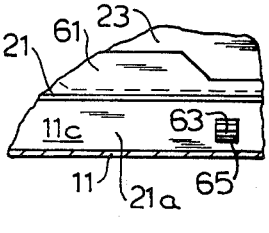
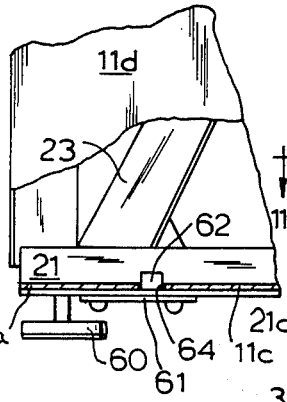
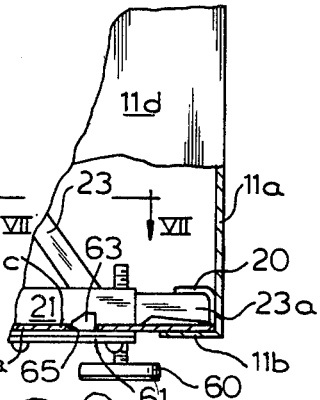
FIG. 6
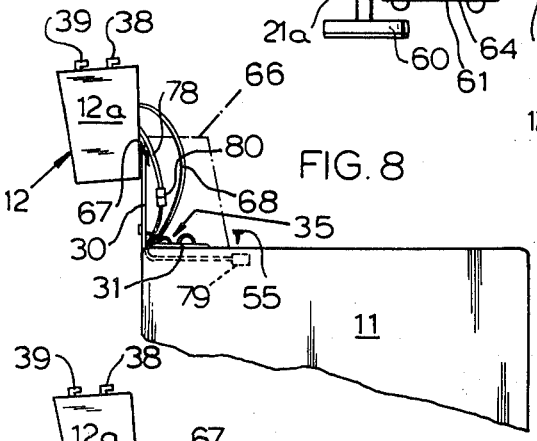
FIG. 8
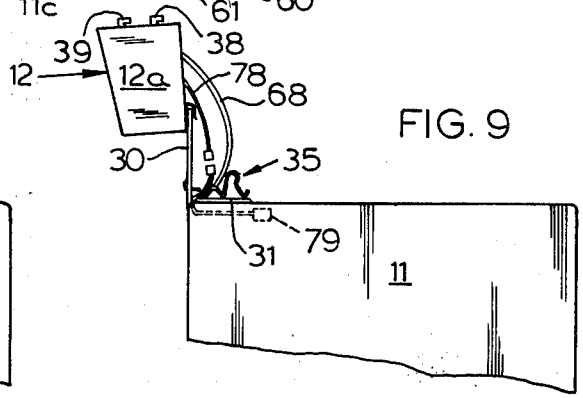
FIG. 9
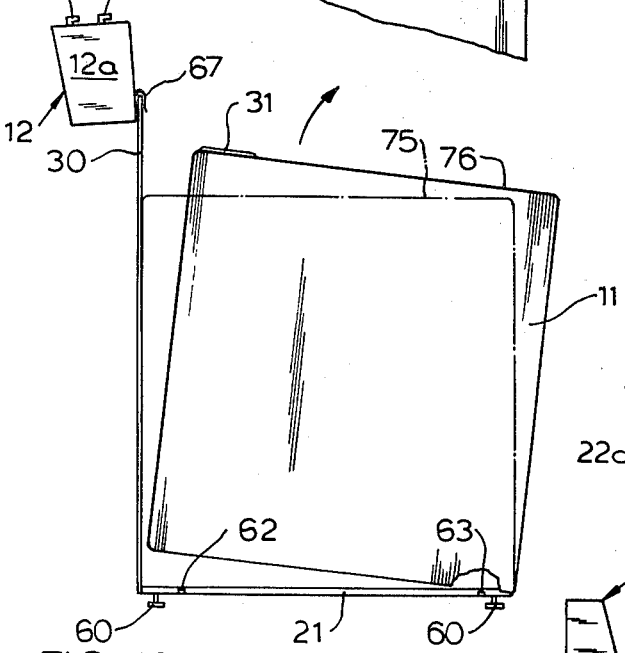
FIG. 10
FIG. 11
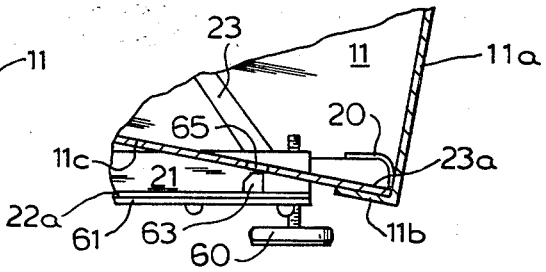
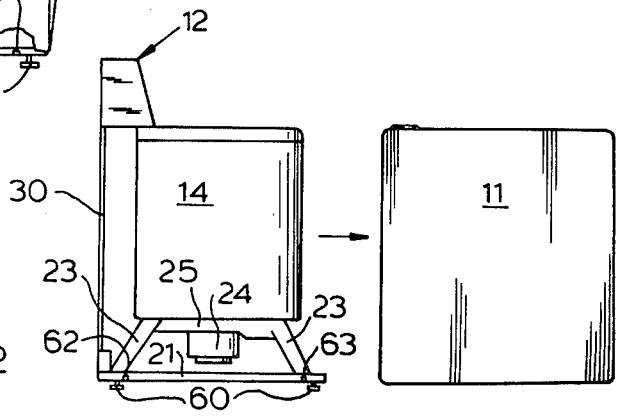
FIG. 12

RETAINING CLIP FOR REMOVABLE CABINET FOR FRONT-SERVICEABLE APPLIANCES

BACKGROUND OF THE INVENTION

1. Field of the Invention

The present invention relates to cabinets for appliances, and in particular to removable cabinets for front-serviceable appliances and methods of attaching such cabinets.

2. Description of the Prior Art

Most domestic appliances, such as automatic washers, have internal operative components covered by a cabinet which is attached to a frame supporting the internal components. Servicing of the appliance is hampered because the internal components are inaccessible unless the cabinet is removed. Such cabinets are held in place by screws, bolts, or other attachment means which must be manually disengaged before the cabinet can be removed. An additional problem is that frequently some internal components are attached in some way to the cabinet so that once the cabinet is removed those parts become nonfunctional, and must be rigged for operation without the cabinet in order to service the appliance.

SUMMARY OF THE INVENTION

In accordance with the principles of the present invention a removable cabinet for a front-serviceable laundry appliance has a cabinet wrapper including a front and two sides joined to a top. The cabinet wrapper is fitted over a base frame supporting internal components and to which an upwardly extending rear panel is attached. The bottom portions of the cabinet sides have apertures or slots therein for receiving upwardly extending alignment tabs on side members of the base frame. The front of the cabinet has a bottom portion having a flange which overlaps and extends beneath an outwardly extending front member of the frame to prevent upward movement of the front of the cabinet when it rests on the base.

The appliance has a control housing having a control panel which is hingedly attached to an upper portion of the rear panel so that the control housing can be pivoted from a position on top of the cabinet to a position above the rear panel. The sides of the control housing have downwardly extending tabs for engaging aligned slots in the top of the cabinet.

A pair of spring clips, normally covered by the control housing, are exposed when the housing is lifted. Each clip has a rear flange which engages the rear panel and a series of curved portions for engaging slots in the top of the cabinet and locking the cabinet in place. A first curved portion abuts the top of the cabinet, another curved portion extends into a first slot in the cabinet, and a last curved portion extends through another slot in the cabinet and has a rearwardly extending portion which engages an edge of the slot to exert retaining tension on the clip.

Removal of the cabinet is easily achieved by disengaging the control housing and lifting it upwards to expose the clips, releasing the clips, rocking the cabinet forward off of the alignment tabs, and moving the cabinet forward to disengage the front flange from the base. With the exception of the necessity of jumping a lid safety switch, the exposed components are functionally intact, so that maintenance can be undertaken without further preparation.

BRIEF DESCRIPTION OF THE DRAWINGS

FIG. 1 is a perspective view, partly broken away, of a laundry appliance having a removable cabinet embodying the principles of the present invention.

FIG. 2 is a fragmentary plan view, partly in section, of the appliance of FIG. 1.

FIG. 3 is an enlarged fragmentary sectional view of the appliance taken along line III—III of FIG. 2.

FIG. 4 is an enlarged sectional view of a clip engaging the removable cabinet of FIG. 1 showing a suggested method of disengagement.

FIG. 5 is a detail sectional view of a clip engaging the cabinet of FIG. 1 showing a suggested method of engagement.

FIG. 6 is a fragmentary side elevational view, partly in section, of the appliance of FIG. 1.

FIG. 7 is an enlarged sectional view taken along line VII—VII of FIG. 6.

FIG. 8 is a fragmentary side view of the appliance of FIG. 1 with the control housing elevated to show an engaged clip.

FIG. 9 is a fragmentary side view of the appliance of FIG. 1 with the control housing elevated and the retaining clip disengaged.

FIG. 10 is a schematic side view showing the method of removing the cabinet of FIG. 1.

FIG. 11 is an enlarged fragmentary sectional view of the lower front of the appliance of FIG. 10.

FIG. 12 shows the exposed internal components of the appliance of FIG. 1 after removal of the cabinet.

DESCRIPTION OF THE PREFERRED EMBODIMENTS

A laundry appliance of the vertical axis type embodying the principles of the present invention is shown generally at 10 in FIG. 1. The appliance 10 has a removable outer cabinet 11 including a cabinet wrapper consisting of two side panels **11*d* and an integral front panel 11*a*, and a control housing 12 having a control panel 13 thereon. The cabinet 11 houses a stationary tub 14 therein, containing a perforate spin basket 16. An agitator 17 is vertically disposed inside the spin basket 16. A generally circular opening 15 in the top of the tub 14 for entry and removal of laundry is covered by a hinged cabinet lid 18 in a cabinet top 19**.

The appliance 10 includes internally supported functional components comprising a motor and drive means 24 which is supported on an interior frame 25. The frame 25 is in turn supported in tripod fashion by three struts 23 (FIGS. 1 and 12). A suspension mechanism 26 minimizes transfer of vibrations from the moving interior parts of the cabinet 11.

A base frame 9 is attached to the struts 23 consisting of a front member 20, a left side member 21, a right side member 22 and a rear member **9*a* (FIG. 12) connecting the side members to each other and to rear strut 23. As shown in FIGS. 6 and 7, the left frame member 21 has a horizontal portion 21*a* having an upwardly extending rear tab 62 and a front tab 63. The tabs 62 and 63 respectively engage apertures or slots 64 and 65 in a bottom side flange 11*c* of the cabinet side 11*d***.

As also shown in FIG. 6, the base further consists of frame members 61, attached to the side member 21 and also side member 22 (not shown) and feet 60 which may be adjustable to level the appliance 10.

Each of the front struts 23 has an extension 23*a* thereon to which the front base frame member 20 is attached. The front 11*a* of the cabinet 11 terminates in overlapping relationship to front member 20 and has a horizontal flange 11*b* which extends beneath the extension 23*a* and the front member 20 to prevent upward movement of the cabinet 11 at the front portion thereof.

Referring to FIGS. 2, 3 and 12 a rear panel 30 is attached by suitable means such as screws to the base frame rear member 9*a* and extends upwardly therefrom. Referring to FIG. 9, the rear panel 30 extends a distance beyond the top 19 of the cabinet 11 a distance equal to the height of a side 12*a* of the control housing 12. The control housing 12 is attached to the top of the rear panel 30 by a hinge 67. When the control housing 12 is in the position shown in FIGS. 1, 2 and 3 a downwardly extending rear tab 38 engages a slot 36 in the top 19, and a downwardly extending front tab 39 engages a slot 37. As shown in FIG. 3, a horizontal strip 53 at the bottom of the control housing 12 has screws 55 extending therethrough and received in plastic members 54 attached to the cabinet top 19 for further securing the control housing 12 to the top.

The control housing 12 covers two identical configurations on opposite sides of the top 19 for receiving a cosinusoidal shaped retainer clip 35. Each configuration is integral with the top 19 and consists of two parallel ridges 31 extending normal to the rear panel 30. A second pair of parallel ridges 32 and 32*a*, perpendicular to the ridges 31, divide the area between the ridges 31 into three sections. A slot 33 is disposed in a middle section, and a slot 34 is disposed in a section farthest from the rear panel 30. The ridges 31 and 32 provide added strength to the top 19 of the area around slots 33 and 34, but need not be utilized if the added strength is not required.

The slots 33 and 34 receive portions of the retainer spring clip 35 as shown in detail in FIGS. 3, 4 and 5. A flanged end 40 of the clip 35 extends through the rear panel 30 at aperture 40*a* to provide a stop against which the spring clip 35 can be tensioned. The clip 35 has a first curved portion 41 which abuts a portion of the top 19 between the rear panel 30 and ridge 32. A second curved portion 42 extends over the ridge 32 and joins a third curved portion 43 which extends into and bears against an edge 33*b* of the slot 33. A fourth curved portion 44 of the clip 35 extends over the ridge 32*a* and joins a retaining means for holding the clip 35 in place comprising a short horizontal portion 45 which is held by spring tension immediately beneath and parallel to the top 19 in slot 34. The section 45 joins a straight section 46 which terminates in a curved flange 47.

A suggested method of disengaging the clip 35 from the slots 33 and 34 in the top 19 is shown in FIG. 4. The blade 50 of a screw driver or other suitable tool is inserted in the flanged end 47 of the clip 35 and a force is applied in the direction indicated by the arrow using the lower part of the curved portion 44 as a fulcrum to disengage the portion 45 from the top 19. Once the section 45 has been disengaged the clip 35 is rotated clockwise as shown in FIG. 4 about flanged end 40 to release curved portion 43 from the edge 33*b* and thus spring tension is no longer exerted at the stop so that the clip 35 may be easily removed.

A suggested method of engaging the clip 35 with the top 19 is shown in FIG. 5. Aligned apertures 48 and 49 in the clip 35 receive a rod 51 or other suitable straight tool. After inserting end 40 in rear panel aperture 40*a*, a generally downward force is applied in the direction of the arrow forcing the clip downward by lever action until the portion 45 engages the top 19.

When the clip 35 is in the position shown in FIGS. 2, 3 and 4 it exerts a downward bias force at curved portion 41 to retain the cabinet 11 against the base frame 9. The clip 35 also biases a flange 19*a* extending downwardly at a right angle to the top 19, against the rear panel 30 through the force created by third curved portion 43 against edge 33*b* of top 19 when the clip is tensioned between edge 33*b* and panel 30. Thus, the retaining clips provide the only connecting means for joining the cabinet 11 to the rear panel 30, and further provides a biasing means biasing the cabinet wrapper against the base frame 9.

A method for removal of the cabinet 11 is sequentially shown in FIGS. 8 through 12. The screws 55 are removed and the control housing 12 is pivoted on the hinge 67 from the broken line position 66 to the position shown in FIG. 8. Electrical wires 68 connecting the operating components to the control components in the control housing 12 are sufficiently long that they need not be disconnected or jumped, and all functions controlled by the control panel 13 are still operative. The only electrical wire that need be disconnected is a wire 78, having a separable connector 80, connecting a cabinet wrapper mounted safety lid switch 79 to the control panel. The clips 35 are thus exposed by pivoting the control housing 12 and can be disengaged by the method shown in FIG. 4 to the position shown in FIG. 9.

After disengagement of the clip 35 from the rear panel 30, and disconnection of electrical wire 78 at connector 80, the cabinet 11 is rocked forward in the direction of the arrow shown in FIG. 10 from the broken line normal position 75 to a position 76 so that the alignment tabs 62 and 63 are respectively disengaged from the receptacles 64 and 65 in bottom flange 11*c*. When the cabinet is rocked as shown in FIGS. 10 and 11, tabs 63 and 62 are freed from their respective slots 65 and 64 and the front flange 11*b* can be slid from beneath the front base member 20 and the cabinet 11 removed as shown in FIG. 12. The control housing 12 can then be moved back to its usual position, and the appliance 10 is operable for servicing. The only additional preparation which need be done is to jump across the open portion of line 78 at connector 80 to simulate a closed lid safety switch which normally allows operation of the appliance 10 only when the switch and the lid 18 are closed.

Although the above description shows use of the cabinet 11 and attachment method with a vertical axis laundry appliance, it will be understood that the inventive concept herein is equally applicable to all types of appliances.

Although modifications and changes may be suggested by those skilled in the art, it is the intention of the inventors to embody within the patent hereon any changes and modifications as reasonably and properly come within the scope of their contribution to the art.

The embodiments of the invention in which an exclusive property or privilege is claimed are defined as follows:

1. In a domestic appliance having a cabinet including a rear panel, a top, a wrapper joined to said top, and a base, a retaining clip for maintaining said cabinet in assembled relationship, said retaining clip comprising:

connecting means for joining said cabinet top to said rear panel, said connecting means including biasing means for urging said top into contact with said rear panel and for biasing said wrapper into contact with said base, said biasing means acting through said top and said back panel to create said wrapper base contact.

2. The appliance of claim 1 wherein said clip includes a retaining means for retaining said connecting means in a biasing relationship to said rear panel, top and base, said retaining means integrally formed to said connecting means.

3. The appliance of claim 1 wherein said top has a slot therein and said rear panel has at least one aperture therein, and wherein said connecting means includes a flanged end of said clip engaging said rear panel in said aperture and said biasing means includes a curved portion of said clip received in said slot, and another curved portion of said integrally connected between said curved portion and said flanged portion, said other curved portion abutting said cabinet wrapper top.

4. In an automatic domestic appliance having a base frame, a cabinet wrapper having two vertical side panels, a vertical front panel, and a top, and a rear panel attached to said base frame and extending above said cabinet wrapper top, the improvement comprising:

at least one spring clip engaging said rear panel and said cabinet wrapper top and utilizing said rear panel as a stop to exert tension in said clip to hold said cabinet wrapper against said rear panel and said base frame.

5. The appliance of claim 4 wherein said rear panel has at least one aperture therein, said cabinet wrapper top has spaced first and second slots therein, and said clip has coterminously connected portions comprising:

a first flanged end engaging said rear panel in said one aperture;

a first curved portion abutting said cabinet wrapper top;

a second curved portion spanning a portion of said cabinet wrapper top;

a third curved portion received in said first slot in said cabinet wrapper top;

a fourth curved portion spanning a distance between said first and second slots; and a straight portion received in said second slot extending a distance adjacent and beneath said top and terminating in a second flanged end, and wherein said first, second, third and fourth curved portions are alternately connected in opposed manner to form a generally cosinusoidal curve.

6. The appliance of claim 5 wherein said second and fourth curved portions each have an aperture therein, said apertures aligned to receive a lever for applying force to install said clip.

7. A spring clip adapted for use with a domestic appliance, said appliance having a cabinet including a rear panel, a top, a wrapper joined to said top and a base, said clip maintaining said cabinet in assembled relationship, said spring clip comprising:

connecting means for joining said cabinet top to said rear panel, said connecting means including biasing means for urging said top into contact with said rear panel and for biasing said wrapper into contact with said base, said biasing means acting through said top and said back panel to create said wrapper base contact.

8. The spring clip of claim 7 wherein said clip has coterminously connected portions comprising:

a first flanged end engaging an aperture in said rear panel;

a first curved portion abutting said cabinet wrapper top;

a second curved portion spanning a portion of said cabinet wrapper top;

a third curved portion received in a first slot in said cabinet wrapper top;

a fourth curved portion spanning a distance between said first slot and a second slot in said cabinet wrapper top; and a straight portion received in said second slot extending a distance adjacent and beneath said top and terminating in a second flanged end, and wherein said first, second, third and fourth curved portions are alternately connected in opposed manner to form a generally cosinusoidal curve.

* * * * *

UNITED STATES PATENT AND TRADEMARK OFFICE

CERTIFICATE OF CORRECTION

PATENT NO. : 4,268,098

DATED : May 19, 1981

INVENTOR(S) : Gerald L. Kretchman et al.

It is certified that error appears in the above—identified patent and that said Letters Patent is hereby corrected as shown below:

Claim 3, line 7, before "integrally" insert --clip--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*